US005473917A

United States Patent [19]

Say

[11] Patent Number: 5,473,917

[45] Date of Patent: Dec. 12, 1995

[54] BICYCLE/SKI LOCK

[76] Inventor: James L. Say, P.O. Box 1418, Frisco, Colo. 80443

[21] Appl. No.: 120,781

[22] Filed: Sep. 15, 1993

[51] Int. Cl.[6] ..... E05B 67/24; E05B 73/00

[52] U.S. Cl. ..... 70/49; 70/14; 70/18; 70/57; 70/58; 280/814

[58] Field of Search ..... 70/18, 14, 30, 70/49, 58, 57, 233; 211/70.5, 8; 280/814; 206/403–406, 580, 303

[56] References Cited

U.S. PATENT DOCUMENTS

| | | | |
|---|---|---|---|
| 3,354,675 | 11/1967 | Quigg | 70/58 |
| 3,369,653 | 2/1968 | Edwards | 206/406 |
| 3,467,923 | 10/1968 | Mathus | 206/406 |
| 3,590,608 | 7/1971 | Smyth | 70/15 |
| 3,670,535 | 6/1972 | Stettner et al. | 211/70.5 |
| 3,736,777 | 6/1973 | Wirth | 206/303 |
| 3,841,118 | 10/1974 | Stone | 70/15 |
| 3,999,410 | 12/1976 | Hall | 70/18 |
| 4,098,099 | 7/1978 | Smith | 70/18 |
| 4,146,242 | 3/1979 | Bose | 70/58 |
| 4,398,403 | 8/1983 | Menick | 70/18 |
| 4,597,273 | 7/1986 | Reichenberger | 280/814 |
| 4,811,577 | 3/1989 | Webster et al. | 70/58 |
| 5,279,136 | 1/1994 | Perry | 70/58 |
| 5,398,530 | 3/1995 | Derman | 70/58 |

*Primary Examiner*—Darnell M. Boucher
*Attorney, Agent, or Firm*—Rick Martin

[57] ABSTRACT

An integrated security cable, locking mechanism, and storage case particularly designed for locking skis, bicycles, snowboards, and similar articles to stationary objects such as trees and posts. The lock is employed by removing the lock and cable from the case. The cable is passed around the first object and back through an eye fitting. The annular storage case is so designed as to allow the cable end to pass into a center opening and coil around the interior wall of the case. The lock body then follows the cable into the center opening where it is retained by a snap fit between the lock mechanism and the case. The complete assembly is then easily carried in a jacket pocket or pouch.

8 Claims, 3 Drawing Sheets

FIG. 3
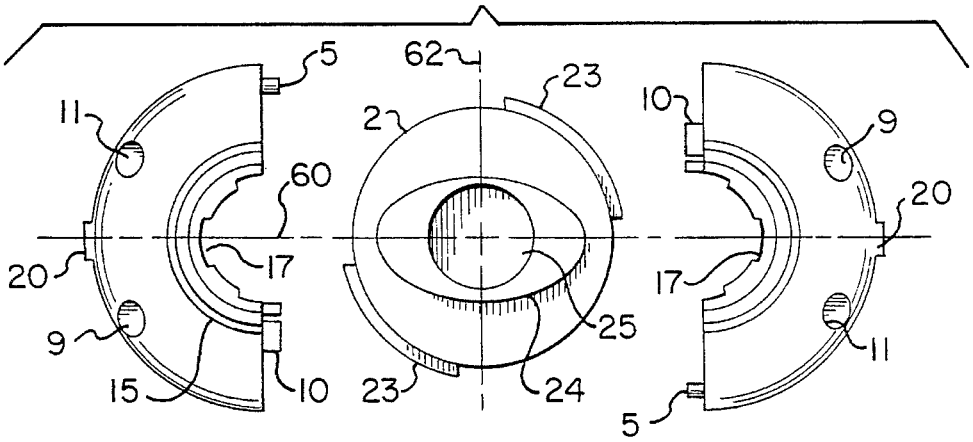
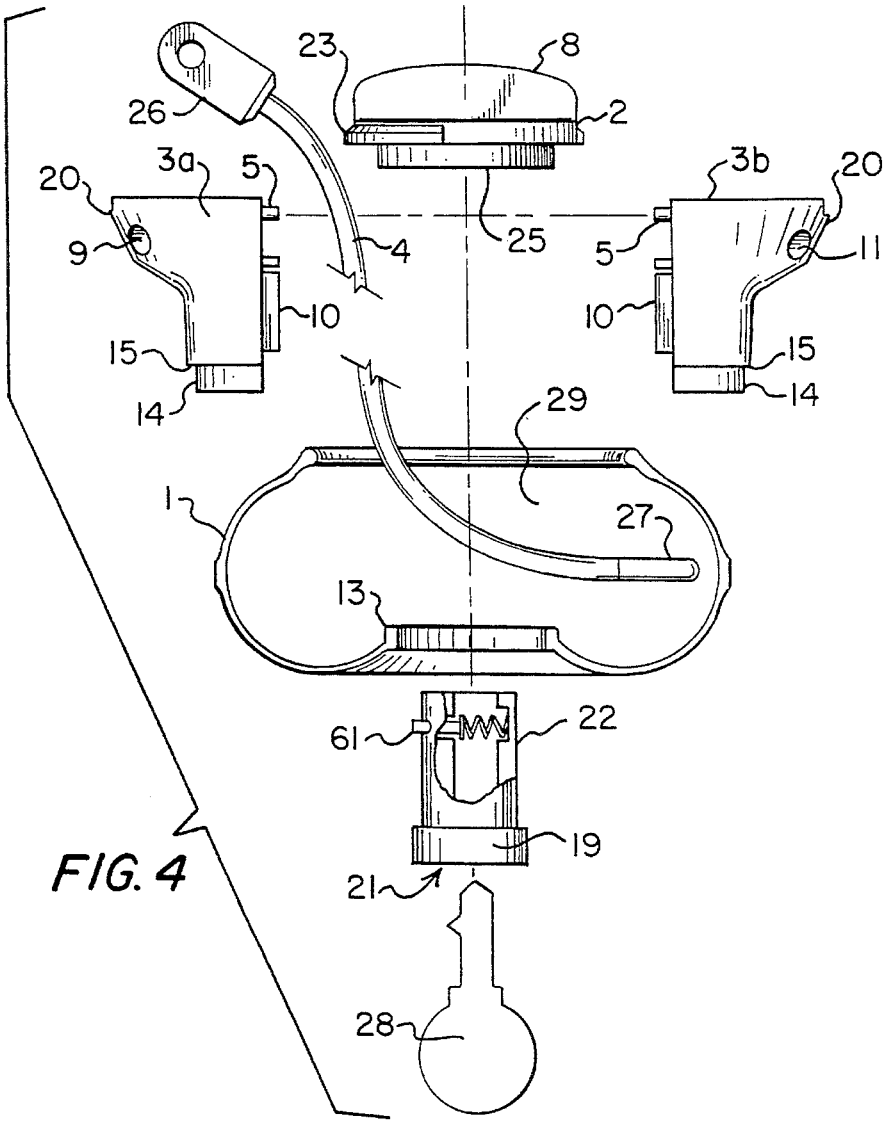
FIG. 4

BICYCLE/SKI LOCK

FIELD OF INVENTION

The present invention relates to the field of cable locks and particularly to a light weight locking assembly that stores the lock and cable separately within a portable storage housing.

BACKGROUND OF THE INVENTION

Cable locks are well understood and in the past have been employed to secure personal items such as skis and bicycles. The simplest such lock uses a steel cable with two closed loops formed at the cable ends and a padlock. The cable is passed around or through the object to be secured and a second stationary object. The two are then secured together at the cable loop ends by passing the cable shackle through the two loops and setting the lock. A popular variation of this approach replaces the loops and padlock with a locking device affixed to one end of the cable. Illustrative examples of such locks are disclosed in the U.S. Pat. Nos. 3,855,824 and 4,075,878. Locks of this type typically use a keyed cylinder lock or combination lock mechanism to secure the open loop. The other cable end generally terminates with a swaged fitting appropriate for retention by the locking device. Because cable locks of this design are inherently cumbersome for bicycle riders and skiers to carry, various other designs are in use that store the cable on spring loaded reels or form the cable so that it becomes self coiling when not in use. When the problem of cable storage is addressed through reels and spring loaded winding mechanisms, the mechanisms add significant additional weight, cost and bulk to cable locks often limiting the portability and convenience of such locks. Illustrative examples of locks attempting to solve the problem of cable storage are disclosed in U.S. Pat. Nos. 3,922,894 and 4,126,024 in which the improvement results in comparatively heavy cable storage mechanisms that are affixed to the particular object that is to be locked and not portable for other use.

Whatever approach is used to lock and/or store cable, most cable locks depend on a single closed cable loop of fixed size to secure the personal item to itself or to another object. This design can require nearly double the cable length than is actually needed to link two objects thus adding unnecessary weight and cost over a given reach, and also results in the disadvantage of the loop being too long or too short for many applications thus preventing the consumer form easily reducing the slack between the two locked objects or substituting a longer cable where needed. In the case of snowboards or skis the fixed loop requires that an incidental opening on the bindings be present so the cable end may be passed through or some physical attachment such as an eye bolt be made to the equipment in order to secure these items with a cable lock. Whereas, an adjustable loop that could be tightened around the smallest sectional area of objects then locked, would offer increased locking options and convenience.

One device that recognizes this disadvantage and provides a partial solution is disclosed in U.S. Pat. No. 4,325,238 in which the closed loop is adjustable by increments at structures formed along the cable length. This particular lock does not adequately solve the problem as the structures simply add more fixed loops of decreasing size as well as adding considerably to the weight and manufacturing costs.

Another disadvantage of such locks is that the locking body is often much heavier than is necessary for defense against casual theft wherein the thief does not employ sophisticated tools to defeat the lock mechanism. Casual or opportunistic theft is the most common form of loss to such articles as skis and bicycles however, lock bodies typically are of a generic design for multiple applications that are then adapted for light duty cable lock use. They are generally constructed of hardened steel and are often many times stronger than the cable they are attached to. As a result, even persistent thieves rarely attack the lock body but instead simply cut the cable.

Hence, there exists a need for providing a less costly, lighter weight, lighter duty cable lock device that is storable within a separate housing so that it may be easily carried in the clothing of the consumer for portable use on sporting equipment such as skis, bicycles, snowboards, and other personal articles.

SUMMARY OF THE INVENTION

This invention is an integrated security cable, locking body, and storage case more compact and lighter weight than many existing locks. The assembled device is to be carried in the pockets of clothing, bike tool pouches or the like. The lock is designed for protection against opportunistic theft, this being the most common form of loss for articles such as skis, snowboards, and bicycles. The lock is employed by first releasing the lock body from the storage case. Thumb or finger pressing inwardly against the lock body keyway releases the lock body. The cable end can then be pulled from the storage case where the cable is coiled by natural resistance against the interior annular wall of the case. Affixed to one end of the cable portion is a structure with a diametrical opening in the form of an eye sufficiently large to allow the opposing cable end to pass easily through. This opposing cable end terminates in a second smaller structure in the form of a pin that facilitates smooth passage through the cable eye, lock body, and interferences that may be encountered while setting the cable around the objects to be secured.

Once the lock body and cable are free from the storage case, the key is inserted in the cylinder lock keyway and the knob is rotated counterclockwise ninety degrees or until the knob rotation limit stops are felt and the long axis of the knob face is midway between the two parallel passages extending through the lock body. The smaller structure at the end of the cable is then threaded around and/or through the first object, then through the larger cable eye structure at the opposing cable end, then through one of two parallel passages extending through the lock body, then around and/or through the second object, then back through the other parallel passage extending through the lock body. The lock is set by turning the knob clockwise ninety degrees or until the opposing knob rotation limit stops are felt and the long axis of the knob face is perpendicular to the long axis of the parallel passages. The key is then removed from the cylinder lock therein setting the lock.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such constructions do not depart from the spirit and scope of the invention as set forth in the succeeding claims.

It is an object of the invention to provide anti theft lock means employing a standard cylinder lock sometimes referred to as an industrial lock plug, a lock body, a housing and flexible cable in conjunction with skis, snowboards, bicycles, and similar such personal articles and a stationary object such as a post or tree.

Another specific object is to provide a lock means as set forth herein above further including a structure at one end of the cable in the form of an eye to allow the other end of the cable to be passed back through, therein creating an adjustable first loop capable of enclosing a combination of the personal articles and/or the stationary object previously described.

Another specific object is to provide a lock means as set forth herein above further including a lock body comprising a rotatable knob and key operable cylinder lock, the assembly slidable onto the cable by traverse of the cable through two transverse passages, wherein the cable forms an adjustable second loop by it's travel and the cable may be then locked within the passages at any point along the cable's length by rotation of the knob, followed by removal of the key. The second loop is also capable of enclosing the personal articles and/or the stationary object previously described.

Another specific object is to provide a lock means as set forth herein above further including the lock body with means for containing and positioning the rotatable knob and cylinder lock.

Another specific object is to provide a lock means as set forth herein above further including the rotatable knob with means provided for limiting the rotation arc of the knob to the sweep between the locked and unlocked position.

Another specific object is to provide a lock means as set forth herein above further including the rotatable knob with means to displace the flexible cable within the lock body radially and toward an axis that is ninety degrees to the longitudinal axis of the two lock body passages.

Another specific object is to provide a lock means as set forth herein above further including the rotatable knob with a structure extending externally from the lock body therein providing means for manually rotating the knob.

Another specific object is to provide a lock means as set forth herein above further including connective means between the rotatable knob and cylinder lock.

Another specific object is to provide a lock means as set forth herein above further including a housing for the flexible cable and the lock body wherein both are easily stored within the housing and the housing is made compact and portable for transport within pockets of clothing.

Another specific object is to provide two openings in the housing wherein the larger opening is at the top of the housing and the smaller opening is at the bottom. The larger opening being provided for the passage of the cable and the lock body into the housing for storage and the smaller opening being provided for positioning the bottom of the lock body when stored within the housing.

Another specific object is to provide a lock means as set forth herein above further including temporary connective means between the lock body and the housing in the form of a snap fit structure on at least one interface of the housing and the lock body for the purpose of retaining the lock body within the housing when stored.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 3 is a bottom exploded view of the lock body and knob (housing and cylinder lock not shown).

FIG. 4 is an exploded view of all elements of the invention with the cylinder lock and key shown in diagrammatic view and all showing their relationships for assembly and use.

DESCRIPTION OF THE PREFERRED EMBODIMENT

Figure 1:
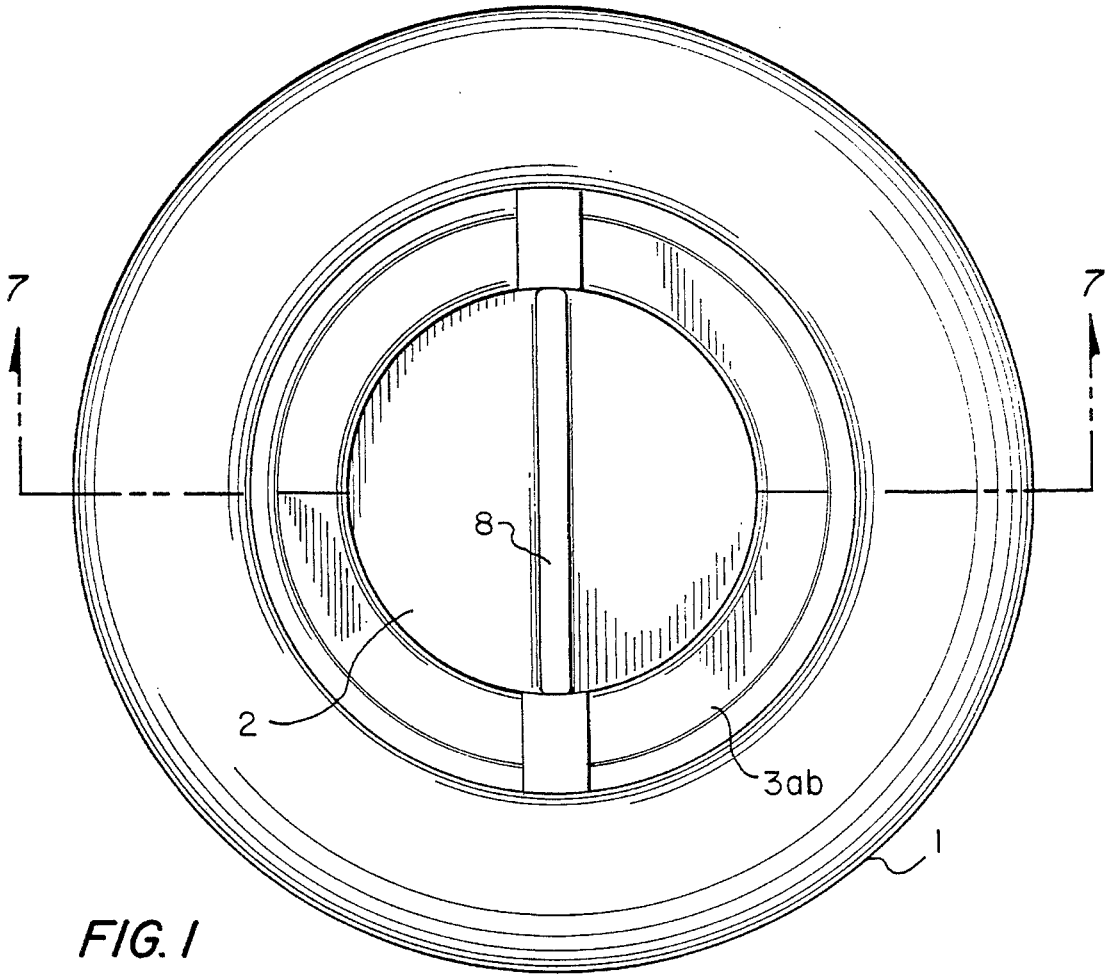
FIG. 1 is a top view of the invention showing the top surfaces of the housing, lock body, and knob.
Figure 2:
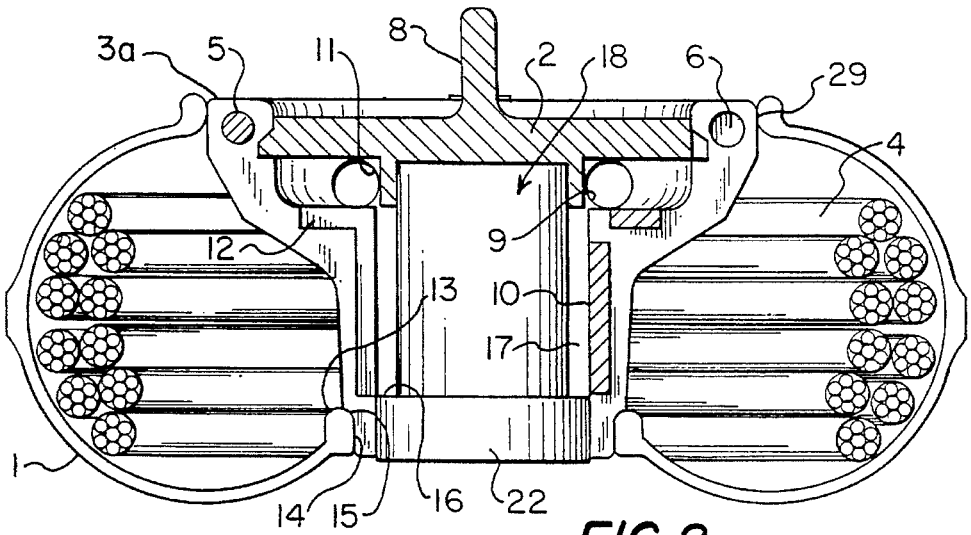
FIG. 2 is a full sectional view of the lock elements, stored within the housing with the cylinder lock shown in diagrammatic view and all taken in section substantially along line 7—7 of FIG. 1.
Figure 7:
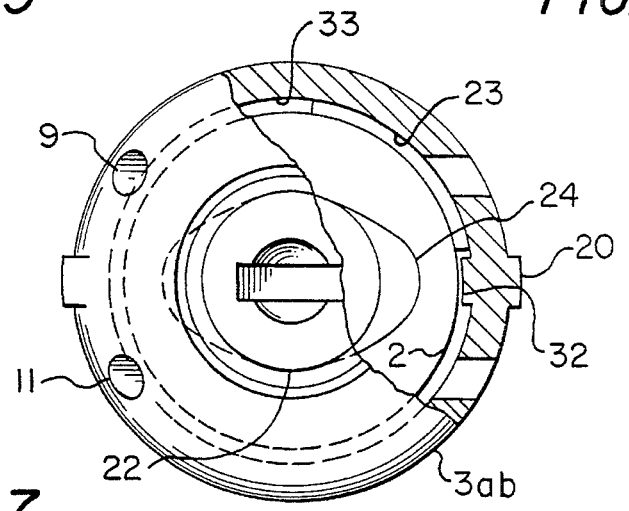
FIG. 7. is a bottom partial section diagrammatic view of the lock body assembly showing detail of the tongue and groove annular segments and the rotation limit stops. Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Referring first to FIGS. 1 and 2, the invention is shown in it's assembled form. The section taken along line 7—7 is commensurate with the plane formed by the joining faces of the lock body case members **3*a* and 3*b* thereby revealing in FIG. 2 lock body case member 3*a* in partial section and lock body case member 3b not shown. The knob 2 and cylinder lock 22 are initially aligned for assembly so that the tongue 23 and groove 33 elements (shown in FIG. 7) will provide succeeding alignment for the cylinder lock 22 tumblers (not shown) to engage the appropriate longitudinal keyways 17 within the central cavity 18 of the lock body 3*ab*. The knob 2 and cylinder lock 22 are joined by the means of attachment (favorably a sonic weld) at the terminus pocket 25 of the knob 2 (shown in FIG. 4**).

The lock body case members **3*a* and 3*b* are joined in manufacture by means of attachment, favorably in the form of a sonic weld, at the projections 10 and 6 which meet with opposing mirrored cavities 5 and 12 when joined. The joined knob 2 and cylinder lock 22 is disposed within the central cavity 18 of the lock body case members prior to the case members 3*a* and 3*b* being assembled. Alignment for the assembly is provided by mating the tongue elements 23 of the knob 2 with the corresponding groove element 33 of the lock body case member 3*a* or 3*b*. The knob 2 and cylinder lock 22 are further positioned by an interior annular flange 16 formed near the bottom of the lock body case member 3***a* or 43*b* in communication with an opposing structure typical to this class of cylinder locks wherein the cylinder lock is in the form of a stepped cylinder with the largest diameter at the key slot end 19 and the annular flange 16 is in communication with the step between the larger and smaller diameters. When the lock body case members 3*a* and 3*b* are joined, the annular tongue and groove structures 23, 33 and the interior annular flange 16 serve to contain the knob 2 and cylinder lock 22 longitudinally within the assembled lock body 3*ab*. The resulting sub assembly of lock body case members 3*a* and 3*b*, knob 2, and cylinder lock 22 then become the lock body 3*ab*.

The flexible cable 4 is favorably of braided steel with a plastics material coating and is shown in section coiled and held in place by natural resistance of the coils against the interior wall of the housing 1 (FIG. 2).

Referring next to FIGS. 3, 4 the lock body 3*ab* is stored within the housing 1 and held in position, by means of a snap fit structure 20 formed diametrically at the bottom of the largest diameter of the lock body 3*ab*, and by means of an external annular abutment 15 formed at the upper terminus of the smallest external diameter 14 of the lock body 3*ab* and in communication with the smaller annular edge 13 of the housing 1.

Figure 5:
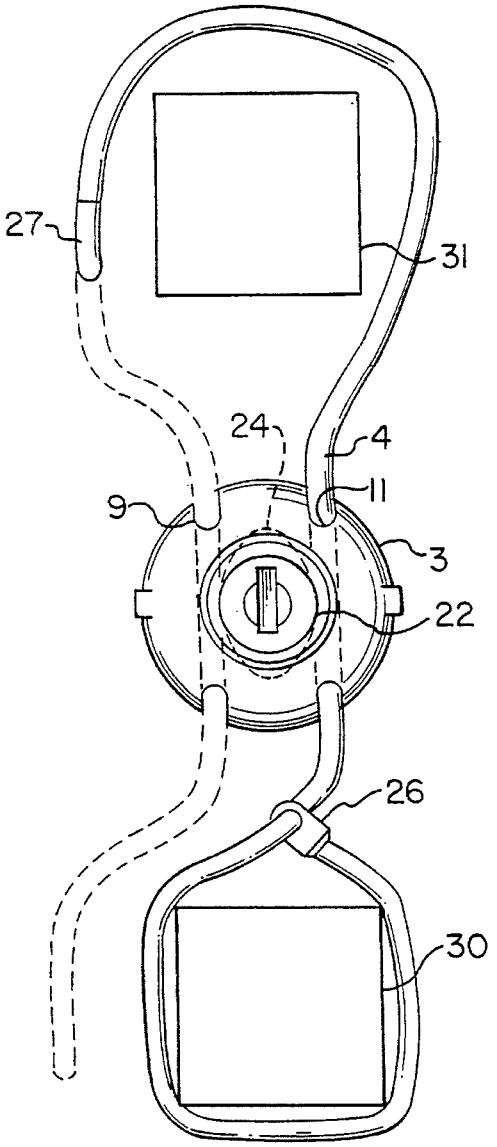
FIG. 5 is a diagrammatic partial hidden line bottom view of the lock in use, showing the cylinder lock keyway face, the lock body, the cable, and cable path as operatively applied around two objects to be secured and the diametrically formed structure (in hidden line at unlocked position) for displacing the cable from it's direct path through the lock body (housing not shown).
Figure 6:
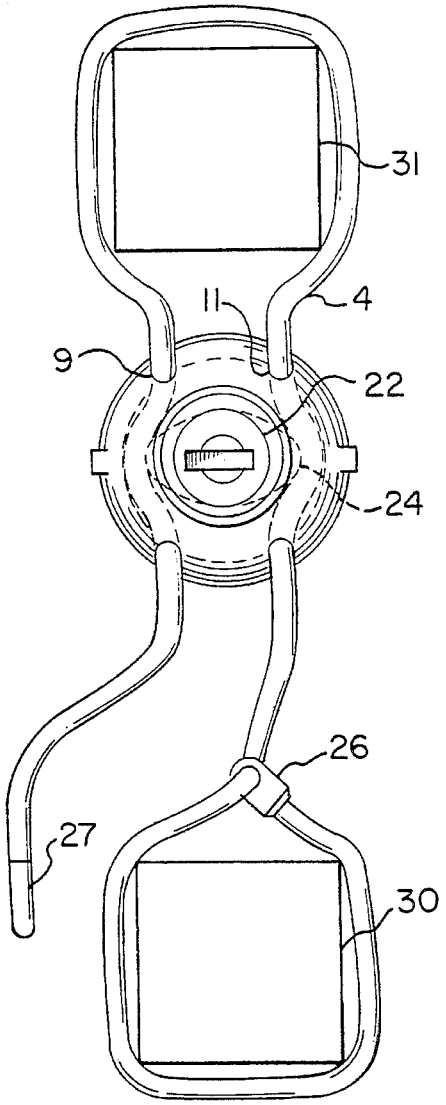
FIG. 6 is as FIG. 5 except that all elements are shown in the locked position.

The lock body 3*ab* is released from the housing 1, by upward thumb or finger pressure against the key slot face 21 of the cylinder lock 22. Once the lock body 3*ab* is removed from the housing 1, (referring now to FIGS. 4 and 5) the eye 26 fitting formed at one at the end of the flexible cable 4 may be withdrawn through the major lumen 29 of the housing 1 carrying with it the flexible cable. 4. The flexible cable 4, once freed from the housing 1, may now secure a first object 30, (see FIGS. 5, 6) by first passing the smaller pin structure 27 around and/or through the first object 30 and back through the eye fitting 26. The loop formed by this travel may now be drawn tight around the first object 30. The free cable end terminating at the smaller pin structure 27, is then passed through the first cable passage 9 in the lock body 3*ab*, around and/or through the second object 31 and back through the second cable passable 11 in the lock body 3*ab* also referred to as the central body.

Referring again to FIG. 4, with the appropriate key 28 inserted in the key slot face 21 of the cylinder lock 22, (see FIG. 4). the knob 2 may be rotated alternately within the lock body 3*ab* by the external structure 8 provided on the knob, from the unlocked position to the locked position. The rotation movement carries with it the cylinder lock 22 by the means of attachment (favorably a sonic weld) formed at the terminus pocket 25 of the knob 2. The knob 2 and the diametrically opposed structures 24 formed on the knob 2 rotate within the arc defined by the rotation limit stops 32, and the annular tongue 23 and groove 33 segments (FIGS. 6 and 7) therein displacing the flexible cable 4 radially towards a vector that is ninety degrees from the long axis of the passages 9, 11. The cable 4 is thereby prevented from being withdrawn from the lock body 3*ab* (see FIG. 5) by: the increasing reluctance due to stiffness of the flexible cable 4 to travel in a direction not parallel to the forces acting upon it, as well as by frictional resistance at the contact points between the flexible cable 4, the cable passages 9, 11, and the diametrically opposed structures 24 formed on the knob 2. The exact distance needed for the diametrically opposed structures 24 formed on the knob 2 to deflect a particular cable within a particular lock body configuration and immobilize it against a given force acting to move the cable along its length may be defined by experimentation. However, it should be understood by those skilled in the art that a resistance to travel exceeding the breaking point of a given cable can be demonstrated by employing such deflection means therein providing the primary operative principle for the invention.

Once the knob 2 is set in the locked position, the key 28 is removed from the key slot face 21 of the cylinder lock 22, therein setting the lock and securing the two objects 30, 31 together. It should be appreciated that other arrangements of the flexible cable 4, lock body 3*ab*, and various objects to be secured are possible and the description provided in the preferred embodiment is but one of many operative configurations. While the invention has been described in detail for a preferred embodiment, various changes in the details of construction are possible by those skilled in the art without departing from the spirit or scope of the invention.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An anti theft device for securing an object, comprising:

a means for storage having a top, a bottom and a central cavity;

a means for locking having a plurality of cable receiving channels removably disposed in said central cavity of said storage means; and a security cable also removably disposed in said central cavity of said storage means whereby said cable and said locking means may be stored within said central cavity of said storage means when said anti-theft device is not in use and may be removed from said storage case, said cable functioning to encircle, thereby locking said object in place by said locking means.

2. The anti-theft device of claim 1, wherein said locking means further comprises:

a cylinder lock mechanism; and a knob means in communication with said cylinder lock mechanism for rotatably positioning said cylinder lock mechanism, whereby rotating said knob means alternates said cylinder lock mechanism from a locked to unlocked position and from a unlocked to locked position.

3. The anti-theft device of claim 2, wherein said knob means further comprises an obstructing means for intersecting each of said plurality of cable receiving channels in said locking means, whereby rotating said knob causes said obstructing means to press into said security cable disposed inside said cable receiving channel to prevent movement of said security cable within said cable receiving channel.

4. The anti-theft device of claim 3, further comprising:

a key; and said cylinder lock mechanism further comprises a key receiving channel whereby said knob means may only be rotated when said key is inserted in said key receiving channel.

5. The anti-theft device of claim 1, wherein said cable further comprises:

a first and a second end;

said first end further comprises a pin means and said second end further comprises an eye means for receiving said pin means, whereby said security cable may form a first loop around said object by threading around said object, through said eye means, and through said plurality of cable receiving channels.

6. The anti-theft device of claim 5, wherein said storage means further comprises a means for removably snap fitting said locking means into said central cavity of said storage means.

7. The anti-theft device of claim 6, wherein:

said locking means further comprises an annular shape, an upper side and a lower side;

said upper side further comprises an annular tongue and groove; and said knob means further comprises an annular tongue and groove whereby said knob is positioned within said locking means by a predetermined complimentary pairing of said annular tongue and groove of said locking means with said annular tongue and groove of said knob means.

8. The anti-theft device of claim 7, wherein said snap fit means further comprises an annular lip on the bottom of said storage means functioning to constrict the lower side of said locking means whereby said locking means is disengaged from said storage means by applying pressure in a predetermined direction to the lower side of said locking means.

* * * * *